United States Patent [19]

Gongwer

[11] 4,355,434

[45] Oct. 26, 1982

[54] CANNISTER TYPE SUCTION CLEANER

[76] Inventor: Dean W. Gongwer, 66607 C.R. 1, Wakarusa, Ind. 46573

[21] Appl. No.: 205,685

[22] Filed: Nov. 10, 1980

[51] Int. Cl.[3] ..... F23J 1/02

[52] U.S. Cl. ..... 15/327 R; 15/352; 55/471; 55/487; 55/525

[58] Field of Search ..... 55/471, 472, 482, 487, 55/525, 528; 15/327 R, 327 D, 352, 353

[56] References Cited

U.S. PATENT DOCUMENTS 2,531,920 11/1950 Raminger ..... 15/422 X
3,431,581 3/1969 Booth ..... 15/313
3,585,788 6/1971 Wilson ..... 55/487

FOREIGN PATENT DOCUMENTS 421664 12/1932 United Kingdom ..... 15/327 R

*Primary Examiner*—Chris K. Moore
*Attorney, Agent, or Firm*—John J. Gaydos

[57] ABSTRACT

A suction cleaner for sucking ashes and hot coals from a wood burning stove containing an impeller and motor unit and having a filtering member of fire resistant material and impervious to ashes covering the orifices to the impeller and a perforated metal member surrounding the filtering member for preventing hot coals from engaging the filtering member.

7 Claims, 5 Drawing Figures

CANNISTER TYPE SUCTION CLEANER

The present invention relates to a suction cleaner and, more particularly, to a suction cleaner for sucking ashes and hot coals from a wood burning stove and a fireplace.

With the recent increase in the cost of heating a dwelling, many individuals have started using wood as a fuel for generating heat within the dwelling. Inasmuch as wood burns at a much faster rate than coal, ashes and hot coals are deposited more rapidly in the bottom of the stove, consequently frequent removal of such ashes and hot coals from the stove is necessary.

Generally, the ashes and hot coals have in the past been removed with a shovel or the like and placed into a metal bucket or basket. Such method of removing ashes and hot coals from the stove is not entirely satisfactory, especially when the stove is located in a living room or family room of a dwelling because during such removal fine particles of ash become suspended in the air and eventually settle in the room. It would, therefore, be desirable to provide means for removing the ashes and hot coals from a wood burning stove and placing them in a metal container without dispersing any of the small particles of ash in the air.

Accordingly, it is an object of the present invention to provide a suction cleaner with an ash impervious, filtering member of fire resistant material for removing ashes and hot coals from a wood burning stove. Another object of the present invention is to provide a suction cleaner with a perforated member adjacent to an ash impervious filtering member enclosing an impeller and motor unit of the vacuum cleaner for preventing hot coals from contacting the filtering member when the hot coals and ashes are removed from a wood burning stove with the cleaner.

An additional object of the present invention is to provide a suction cleaner of the cannister type having an impeller and a motor unit disposed in a metal container with a perforated member and with a filtering member of fire resistant material for preventing the passage of ashes and hot coals into the orifices of the impeller.

Further objects and advantages of the present invention will become apparent as the following description proceeds, and the features of novelty which characterize the invention will be pointed out with particularity in the claims annexed to and forming a part of this specification.

Briefly, the present invention is directed to a suction cleaner for sucking ashes and hot coals from a wood burning stove or fireplace and comprises a metal container containing a collection chamber and an impeller driven by an electric motor. A flexible metal tube connected to an air inlet opening in the container communicates with the collection chamber. A discharge or exhaust opening provided in the container communicates with the impeller. A filtering member of fire resistent material and impervious to ashes and adjacent to the impeller encloses and separates the orifices to the impeller from the collection chamber, thus assuring that only filtered air passing through the filtering member enters the orifices to the impeller. A perforated metal member, e.g., a metal screen, extends around the filtering member and prevents hot coals from engaging the filtering member when such coals are being deposited with the ashes in the collection chamber of the cleaner during operation thereof.

In the present embodiment, the impeller and the motor depend from and are secured to a top cover of a cylindrical metal container with the inlet and discharge openings being provided in the cover. Clamps secured to the outer wall of the container detachably secure the cover to the container. To facilitate movement of the cleaner, the cleaner is mounted on a dolly having a plurality of wheels.

For a better understanding of the present invention, reference may be had to the accompanying drawings wherein the same reference numerals have been applied to like parts and wherein.

Figure 1:
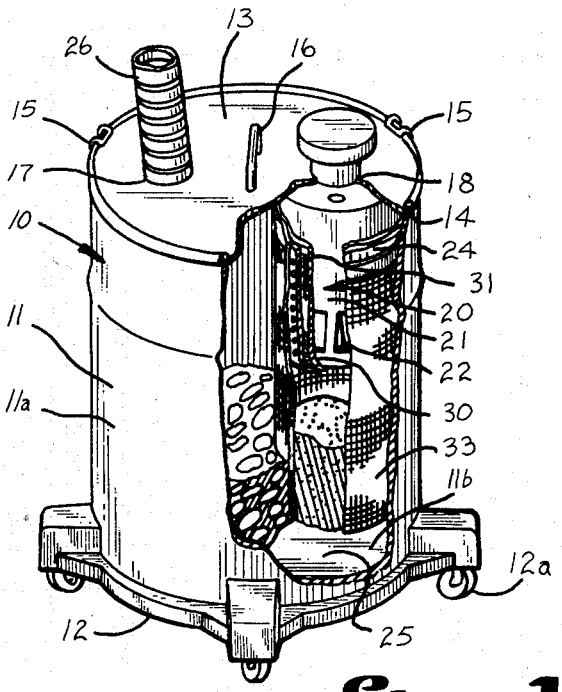
FIG. 1 is an isometric view of a suction cleaner built in accord with the present invention, a portion of the container being removed to expose the inside of the cleaner.

Referring now to the drawings, there is illustrated a suction cleaner of the cannister type, generally designated at 10, comprising a metal container 11 supported on a dolly 12 having a plurality of wheels **12*a* for movement of the cleaner 10 from one location to another. The container 11 is of the cylindrical type having sidewalls 11*a* and an open top closed by an end wall or metal cover 13. A gasket 14 of suitable resilient material seals the joint between the cover 13 and the cylindrical sidewalls 11*a* of the container 11. A plurality of clamps 15 of any suitable design removably secure the cover 13 to the container 11 when the cleaner 10 is in use. A handle 16 is secured to the cover 13 to facilitate lifting of the cover from the container 11 and for carrying the cleaner from one location to another. The cover 13 is provided with an air inlet opening 17 and a discharge opening 18**.

Figure 3:
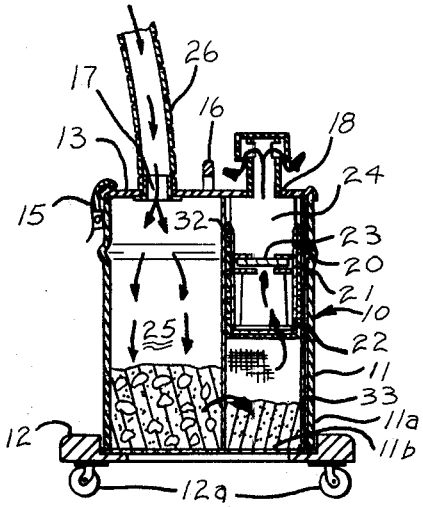
FIG. 3 is a sectional view taken along line III—III of FIG. 2.
Figure 2:
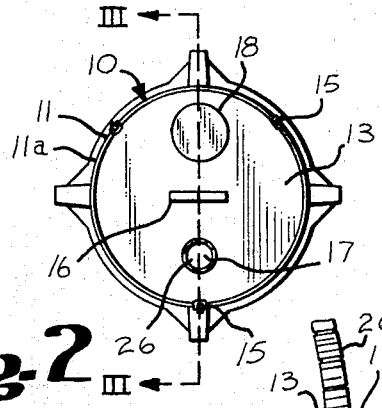
FIG. 2 is a slightly reduced top plan view of the cleaner shown in FIG. 1.
Figure 5:
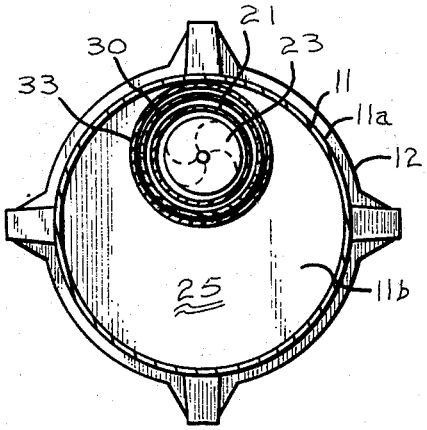
FIG. 5 is a sectional view taken along line V—V of FIG. 4.
Figure 4:
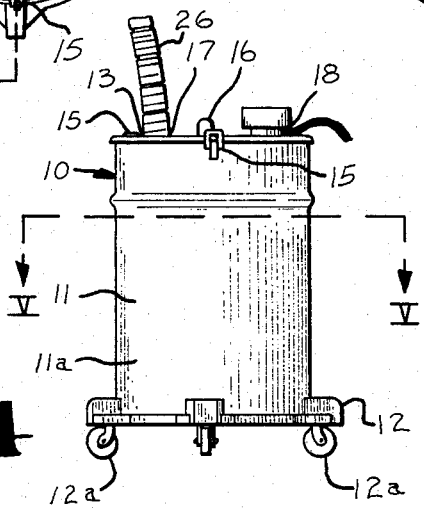
FIG. 4 is a side view of the cleaner shown in FIG. 2.

In the embodiment shown in the drawings, particularly FIG. 3, a combination impeller and motor unit 20 is mounted in a housing 21 fixedly secured to the cover 13. Orifices 22 provided in the housing communicate with the impeller 23. The impeller is of the usual design well known in the art having one or more stages directly coupled to an electric motor 24 preferably of the series type also well known in the art. The remainder of the space in the container 11 not occupied by the impeller and motor unit 20 is defined as a collection chamber 25 and communicates with the air inlet opening 17 and the discharge opening 18 provided in the cover. An elongated flexible metal tube 26 is connected to the inlet opening 17 and is detachably secured to the cover. A not shown insulating handle or suitable heat insulating member is secured to the free or unsecured end portion of the tube 26 for manipulating the end of the tube in a wood burning stove. During operation, the impeller 23 driven by the motor 24 draws air into the container 11 from the air inlet opening 17 through the motor and then through the discharge or exhaust opening 18 provided in the cover 13.

In accord with the present invention and as particularly shown in FIGS. 1 and 3 of the drawings, filtering member 30 encloses the impeller and motor unit 20. The open end 31 of the filtering member 30 is fixedly secured and sealed to the housing 21 thus assuring that the orifices 22 to the impeller 23 receive filtered air. In the present invention, the filtering member 30 is of a woven fire resistant cloth or material capable of filtering air and withstanding the high temperatures and the heat emanating from the hot and/or glowing coals. Fiberglass cloth is extremely suitable for making the filtering member 30. Any type of filtering member is suitable so long as the member 30 filters the air entering the orifices 22 to the impeller 23. The filtering member 30 generally in the form of a bag is secured to the housing 21 with a clamp or draw string 32. In accord with the present invention, a perforated metal member 33 is secured to the housing 21 and to the cover 13 and extends to the bottom or end wall 11*b* of the container 11 to prevent the hot coals from entering the space enclosed by the perforated number 33. The term perforated member denotes any member containing a plurality of openings, e.g., a screen or an expanded metal sheet that has been slit.

When the collection chamber 25 of the container 11 is filled with ashes and coals, the cleaner 10 can be readily emptied by removing the cover 13 and dumping the ashes and coals from the container 11.

While there has been illustrated and described what is at present considered to be a preferred embodiment of the present invention, it will be appreciated that numerous changes and modifications are likely to occur to those skilled in the art, and it is intended in the appended claims to cover all these changes and modifications which fall within the true spirit and scope of the present invention.

The invention claimed is:

1. In a suction cleaner of the type having an open top metal container, sidewalls and a bottom wall, a metal cover closing the open top of the container, a suction creating impeller disposed within the container, a housing enclosing the impeller and provided with an orifice, and an electric motor drivingly connected to the impeller, the container being provided with an air inlet opening and an air discharge opening, the improvement comprising, a perforated metal member adjacent to the orifice in the housing enclosing the impeller, and a filtering member of fire resistant material interposed between the perforated member and the impeller, the space between the inner surface of the sidewalls and the perforated member being adapted to receive hot coals and ashes entering through the air inlet opening, the perforated member restricting passage of the hot coals through the perforated member, the filtering member being pervious to air and preventing passage of ashes through the orifice of the housing enclosing the impeller and through the discharge opening.

2. The cleaner of claim 1, wherein the impeller and the motor are fixedly secured to the metal cover and are spaced from the bottom wall of the container, the perforated member abuts against the bottom wall and circumposes the impeller and the motor.

3. The cleaner of claim 1, wherein the housing is secured to the metal cover, the filtering member is a bag impervious to ashes but pervious to air and covers the orifice of the housing enclosing the impeller, the open end of the bag being secured to the housing.

4. The cleaner of claim 1, wherein the perforated member is a metal screen having openings less than one-eighth of an inch.

5. A suction cleaner for sucking ashes and hot coals from a stove and comprising a metal container having sidewalls and a pair of end walls, one of the end walls being removably secured to the sidewalls for emptying the contents of the container, a suction creating impeller, an electric motor drivingly connected to the impeller and secured to the container, the container being provided with an air inlet opening and an air discharge opening, a housing enclosing the impeller and the motor and provided with an orifice communicating with the impeller, the housing being secured to the end wall removably secured to the sidewalls, and a fire resistant filtering member covering the orifice, the filtering member being impervious to the ashes and the hot coals whereby upon operation of the cleaner air containing ashes and hot coals is sucked into the container and filtered air is discharged from the cleaner while the ashes and hot coals remain in the cleaner.

6. The suction cleaner of claim 5, wherein a perforated member is spaced from and encloses the filtering member for restricting passage of hot coals through the perforated member thereby preventing the hot coals from engaging the filtering member during operation of the cleaner.

7. The cleaner of claim 6, wherein the housing is disposed in the container, and the perforated member is a metal screen surrounding the filtering member.

* * * * *